US008946624B2

(12) United States Patent
Rafferty et al.

(10) Patent No.: US 8,946,624 B2
(45) Date of Patent: Feb. 3, 2015

(54) MASS SPECTROMETER HAVING AN EXTERNAL DETECTOR

(71) Applicant: 1st Detect Corporation, Austin, TX (US)

(72) Inventors: David Rafferty, Webster, TX (US); Michael Spencer, Manvel, TX (US)

(73) Assignee: 1st Detect Corporation, Austin, TX (US)

( * ) Notice: Subject to any disclaimer, the term of this patent is extended or adjusted under 35 U.S.C. 154(b) by 0 days.

(21) Appl. No.: 14/211,827

(22) Filed: Mar. 14, 2014

(65) Prior Publication Data

US 2014/0264013 A1 Sep. 18, 2014

Related U.S. Application Data

(60) Provisional application No. 61/800,732, filed on Mar. 15, 2013.

(51) Int. Cl.
*H01J 49/14* (2006.01)
*H01J 49/24* (2006.01)

(52) U.S. Cl.
CPC ..... *H01J 49/147* (2013.01); *H01J 49/24* (2013.01)
USPC ..... 250/283; 250/292

(58) Field of Classification Search
USPC ..... 250/283, 292
See application file for complete search history.

(56) References Cited

U.S. PATENT DOCUMENTS

| | | | | |
|---|---|---|---|---|
| 5,202,562 | A | 4/1993 | Koga et al. | |
| 6,870,158 | B1 | 3/2005 | Blain | |
| 7,154,088 | B1 | 12/2006 | Blain et al. | |
| 8,704,163 | B2 * | 4/2014 | Schoen et al. | 250/281 |
| 8,785,848 | B2 * | 7/2014 | Wu et al. | 250/292 |
| 2004/0217285 | A1 * | 11/2004 | Smith et al. | 250/292 |
| 2005/0009172 | A1 | 1/2005 | Yamakoshi et al. | |
| 2006/0071161 | A1 | 4/2006 | Syms | |
| 2008/0173809 | A1 * | 7/2008 | Wu | 250/283 |
| 2010/0320377 | A1 | 12/2010 | Cotter et al. | |
| 2012/0267523 | A1 | 10/2012 | Lammert et al. | |

FOREIGN PATENT DOCUMENTS

GB 2180687 A 4/1987

OTHER PUBLICATIONS

Yang et al. "Design of Pocket Mass Spectrometer in a Mobile-Phone Size," The 89th Harsh-Environment Mass Spectrometry Workshop, Sep. 19-22, 2011 (32 pgs.).

International Search Report and Written Opinion dated Sep. 18, 2014 in corresponding International Application No. PCT/US2014/021188, 15 pages.

* cited by examiner

*Primary Examiner* — Kiet T Nguyen

(74) *Attorney, Agent, or Firm* — Finnegan, Henderson, Farabow, Garrett & Dunner LLP

(57) ABSTRACT

A mass spectrometer system is disclosed. The mass spectrometer includes a vacuum chamber defining an enclosed evacuated space and an ion trap disposed in the enclosed space. The ion trap is configured to trap an ionized sample. The mass spectrometer further includes an ion detector coupled to the chamber at a location external to the chamber such that sample ions may exit the evacuated space and into the externally-coupled detector without loss of vacuum pressure.

20 Claims, 5 Drawing Sheets

MASS SPECTROMETER HAVING AN EXTERNAL DETECTOR

CROSS-REFERENCE TO RELATED APPLICATIONS

The application claims priority to Provisional Application No. 61/800,732, filed Mar. 15, 2013, and titled "A MASS SPECTROMETER HAVING AN EXTERNAL DETECTOR," all of which is incorporated herein by reference.

FIELD OF THE DISCLOSURE

The present disclosure relates to a mass spectrometer system, and more particularly, to a mass spectrometer system having an external detector.

BACKGROUND OF THE DISCLOSURE

Chemical analysis tools such as gas chromatographs ("GC"), mass spectrometers ("MS"), ion mobility spectrometers ("IMS"), and various others, are commonly used to identify trace amounts of chemicals, including, for example, chemical warfare agents, explosives, narcotics, toxic industrial chemicals, volatile organic compounds, semi-volatile organic compounds, hydrocarbons, airborne contaminants, herbicides, pesticides, and various other hazardous contaminant emissions. Mass spectrometers measure the atomic mass of a material's constituent molecules and report the masses of these molecules and their relative abundance. This information is used to identify the material. Mass spectrometers may be considered the gold standard for chemical analysis.

As chemical analysis has become a more routine part of many industries, a need has developed for smaller, lighter mass spectrometers that can be incorporated more easily into laboratory and industrial settings and that have lower initial instrument costs and continued operating costs. Additionally, there is a need for portable mass spectrometers that may be used to detect analytes in the field, that have low power requirements and a small size. There are, however, physical limits to the miniaturization of mass spectrometers.

Conventional mass spectrometers may include an ion source, an ion trap, and an ion detector. In smaller devices, these components may be encased within a chamber having an interior volume of approximately 30 $cm^3$. In some instances, the ion detector can occupy more chamber space than the ion source and the ion trap combined.

The location of the ion detector within the chamber can be problematic. For example, the output signal of the detector may be subject to the high voltage RF signal applied to the ion trap. This may result in noise or corruption of the detector signal. Further, the electrical connections required to output the detector signal to processing equipment can add to the size, complexity, and cost of mass spectrometers.

The ion detector typically operates under a vacuum environment, requiring pressures in the range of $10^{-3}$ to $10^{-8}$ Torr for proper operation. Mass spectrometers thus employ pumps, often a system of vacuum pumps, to achieve these pressures, which account for the size and cost of mass spectrometers. The size of the chamber and the corresponding pump system are often limiting factor on the ability to further reduce the size of conventional mass spectrometers.

The size of the chamber has other drawbacks. Because of the relatively large interior volume of the chamber, low volatility compounds such as, for example, explosives and narcotics, may stick to surfaces of the chamber and remain in the chamber after use. These chemicals may outgas slowly and create false leaks or detections, which can be problematic.

Additionally, the large volume of the chamber, as compared to the small volume of the ion trap, means that only a small fraction of the analyte introduced to the system is trapped and analyzed. As a result, the overall sensitivity of the system is reduced. This is an issue where, for example, the mass of an analyte (not concentration) is to be detected.

The present disclosure is directed to a mass spectrometer that addresses one or more of these concerns.

SUMMARY OF THE EMBODIMENTS

The present disclosure relates to a mass spectrometer system, and more particularly, to a mass spectrometer ion trap having an external detector reduce the volume within the vacuum chamber.

One embodiment of the disclosure is directed to a mass spectrometer system. The mass spectrometer may include a vacuum chamber defining an enclosed evacuated space and an ion trap disposed in the enclosed space. The ion trap may be configured to trap an ionized sample. The mass spectrometer may further include an ion detector coupled to the chamber at a location external to the chamber, such that sample ions may exit the evacuated space and into the externally-coupled detector without loss of vacuum pressure.

In various embodiments, the mass spectrometer may include one or more of the following features: wherein the chamber includes an aperture configured to direct ions ejected from the ion trap to the detector; further including a pump to maintain the chamber under vacuum, wherein the externally-coupled detector is housed in a portion of the mass spectrometer that is not under vacuum; wherein the ion detector includes an internal detector tube under vacuum; wherein the tube includes an input end and an output end, wherein the input end is configured to engage a wall of the chamber to provide a pressure barrier so as to maintain the chamber and an interior of the tube under vacuum; wherein the output end is sealed from the ambient air; and wherein the chamber has a volume to accommodate only an electron source and the ion trap.

Another embodiment of the disclosure is directed to a mass spectrometer system. The mass spectrometer system may include a chamber configured to be maintained under vacuum. The chamber may include an ion trap being configured to capture ions generated when a sample is ionized by the electrons emitted from an electron source; and an ion detector configured to detect ions ejected from the ion trap. The ion detector may include a tube configured to be maintained under vacuum. The tube may be coupled to a wall of the chamber at a location external to the chamber.

In various embodiments, the mass spectrometer may include one or more of the following features: wherein the wall of the chamber defines a recess; wherein the tube includes an input end, and wherein the input end is configured to be received in the recess to couple the ion detector to the chamber; further including an o-ring disposed between the input end and the wall in the recess, wherein the o-ring is configured to provide a sealing interface between the input end and the recess; wherein the recess includes a groove to receive the o-ring; further including a fastener to exert pressure onto the tube to press the first end into the recess; wherein the input end is sized to be press-fit into the recess; and wherein the tube includes a fastening assembly configured to position the detector relative to the wall so that an input end of the tube is flush against an outer surface of the wall.

Another embodiment of the disclosure is directed to a mass spectrometer system. The system may include a chamber defining an enclosed space configured to be maintained under vacuum. The chamber may include an ion source configured to emit electrons and an ion trap. The ion trap may include a ring electrode; and first and second end cap electrodes which are arranged on opposite sides of the ring electrode. The first end cap electrode includes a first aperture through which the electrons emitted by the electron source enter the ion trap, and the second end cap electrode includes a second aperture through which ions are discharged from the ion trap. The system may further include an ion detector configured to detect an amount of ions ejected from the ion trap, the ion detector being coupled to the chamber at a location external to the chamber.

In various embodiments, the mass spectrometer may include one or more of the following features: further including an amplifier coupled to the ion detector at a location external to the chamber; wherein the ion detector is a discrete dynode electron multiplier; wherein the ion detector is a channel electron multiplier; and wherein the ion detector includes a vacuum tube having an input end and an output end, wherein the input end sealingly engages a wall of the chamber.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings illustrate certain embodiments of the present disclosure, and together with the description, serve to explain principles of the present disclosure.

DETAILED DESCRIPTION OF THE EMBODIMENTS

Reference will now be made in detail to an exemplary embodiment of the present disclosure, examples of which are illustrated in the accompanying drawings. Wherever possible, the same reference numbers will be used throughout the drawings to refer to the same or like parts.

The disclosure relates generally to instruments for chemical analysis such as, for example, mass spectrometers. The term "mass spectrometer" is used broadly to refer to any components and systems that may be used to detect or identify analytes using mass-to-charge ratios. The terms "analyte," "sample," "material," "chemical," and "ions" may all be used herein to refer to a substance to be analyzed and identified. Such substances include, but are not limited to, gases, proteins, residues and vapors from explosives, chemical warfare agents, toxic chemicals, food and beverage contaminants, and pollution products.

Figure 1:
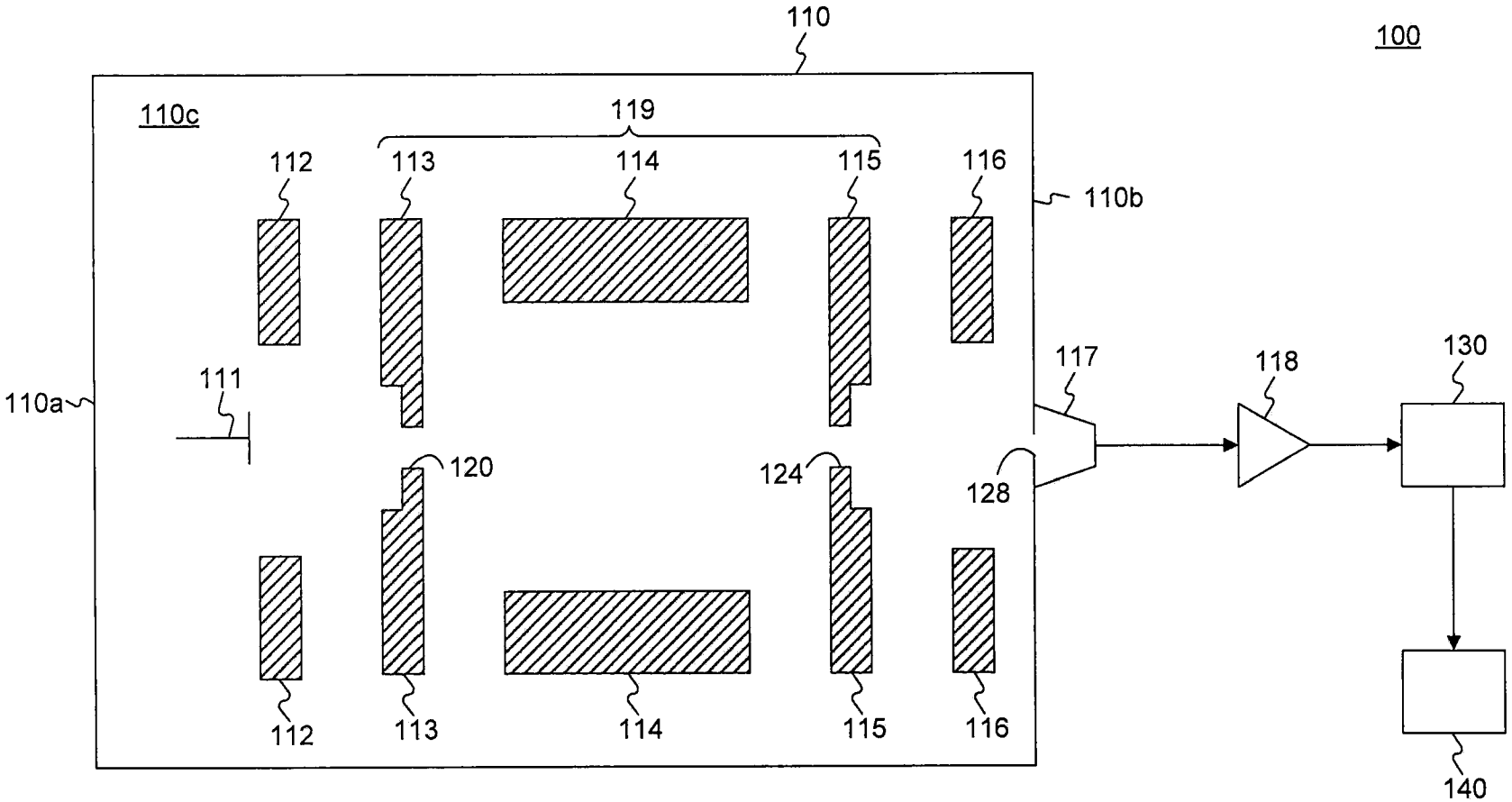
FIG. 1 is a schematic diagram of a mass spectrometer system including a chamber and an external detector.

FIG. 1 illustrates an exemplary mass spectrometer system 100 and related components. The exemplary mass spectrometer system 100 may be used in any suitable environment such as any laboratory, industrial, or commercial setting for applications including research, security, industrial process flow, and health care. Mass spectrometer system 100 may be a stationary instrument or a portable instrument. In the exemplary embodiment, mass spectrometer system 100 may be a miniaturized system. The term "miniaturized" may be used herein to generally refer to a compact, lightweight mass spectrometer system having low power requirements and a small footprint.

As shown in FIG. 1, components of mass spectrometer system 100 include an electron source 111 and an ion trap 119 housed within a chamber 110. Chamber 110 may be a substantially airtight container, constructed from any suitable material known to one of ordinary skill in the art having sufficient strength to withstand forces exerted by the external atmospheric pressure. Such materials may include, but are not limited to, stainless steel, aluminum, brass, high density ceramics, glass, acrylic, Teflon, and plastics. In one embodiment, chamber 110 may be constructed from polyether ether ketone (PEEK), a polymer thermoplastic. Chamber 110 may have any cross-sectional shape/and or configuration, and may be any desired dimension. As shown in FIG. 1, chamber 110 includes at least a first wall 110*a* and a second wall 110*b*, and an enclosed space 110*c* therebetween.

Chamber 110 may be coupled to a vacuum path via one or more ports (not shown) so as to create a low pressure (e.g., vacuum) environment within space 110*c* of chamber 110 for chemical analysis. In some embodiments, the pressure in enclosed space 110*c* is in the range of $10^{-3}$ to $10^{-8}$ Torr. It is contemplated that a series of pumps (not shown) may be employed to achieve the desired operating pressure.

In operation, chamber 110 may be configured to receive a sample and convey the sample to ion trap 119 through one or more inlets (not shown). Electron source 111 may be configured to emit electrons to ionize the sample, and ion trap 119 may be configured to capture the ions and separate one or more of the ions for detection by a detector 117. Detector 117 may be positioned outside chamber 110, to reduce the volume within space 110*c* of chamber 110, and provide a miniaturized mass spectrometer system 100.

As shown in FIG. 1, electron source 111 and ion trap 119 are aligned along a longitudinal axis. In one embodiment, electron source 111 is positioned on a side of ion trap 119 that is opposite of detector 117. Electron source 111 may be any suitable electronic component known to one of ordinary skill in the art that emits electrons such as, for example, an emitter filament. In other embodiments, an ion source may be used. Such devices may include, for example, lasers, chemical ionization agents, electrospray devices, thermospray devices, particle beams, and/or any other type of electron or ion sources.

In the exemplary embodiment, electron source 111 is a filament. Filament 111 may be connected to a power source (not shown). The power source may be removably coupled at an exterior location relative to chamber 110 or, alternatively, the power source may be permanently or removably coupled to chamber 110. The power source may be any suitable source of power configured to, for example, heat filament 111. As noted above, heated filament 111 may be configured to emit electrons.

A first lens 112 is disposed between electron source 111 and ion trap 119. First lens 112 may be any suitable optical component known to one of ordinary skill in the art configured to focus the electrons emitted from electron source 111 into, for example, an electron beam. In this manner, first lens 112 may be configured to adjust a percentage of electrons that enter ion trap 119, and thus control the rate of ionization within the trap. In some embodiments, first lens 112 may be coupled to a controller (not shown). The controller may be configured to modulate the potential and polarity of lens 112 to change the shape of the electron beam directed at ion trap 119 and to gate the electron beam so that no new ions are generated during the ejection phase of the mass scan.

Ion trap 119 is configured to capture ions introduced or created within chamber 110 or within ion trap 119, and eject one or more ions for detection by detector 117. Ion trap 119 may be any suitable type of trap including, for example, a quadrupole ion trap or a linear ion trap employing electric fields for operation. In the exemplary embodiment, ion trap 119 is a cylindrical ion trap.

As shown in FIG. 1, ion trap 119 is an assembly of multiple components including a first end cap electrode 113, a ring electrode 114, and a second end cap electrode 115. In the exemplary embodiment, first end cap electrode 113, second end cap electrode 115, and ring electrode 114 of ion trap 119 form a cylindrical configuration. It is contemplated, however, that that first and second end cap electrodes 113, 115 and ring electrode 114 may form any other shape sufficient to trap ions as part of the operation of mass spectrometer 100.

First and second end cap electrodes 113, 115 may include any suitable shape and/or orientation in ion trap 119. First and second electrodes 113, 115 may also include any suitable conductive material (e.g., copper, silver, gold, platinum, iridium, platinum-iridium, platinum-gold, conductive polymers, stainless steel, etc.) or combinations of conductive (and/or noble metals) materials. In the exemplary embodiment, first and second end cap electrodes 113, 115 may be flat electrodes.

First end cap electrode 113 defines a first aperture 120 through which the electrons emitted by the electron source enter ion trap 119. Second end cap electrode 115 defines a second aperture 124 through which ions are discharged from ion trap 119. First aperture 120 and second aperture 124 may have any length, size, shape and/or configuration. It is contemplated that first aperture and second aperture may have the same or different sizes and/or shapes. It is further contemplated that the geometric parameters of first aperture 120 and second aperture 124 may be selected to provide increased or optimum performance with respect to mass spectrometer system 100.

Ring electrode 114 may be disposed between first end cap electrode 113 and second end cap electrode 115. For example, ring electrode 114 may be disposed half-way or centered between the first end cap electrode 113 and second end cap electrode 115. In some embodiments, the distance between the first and second end cap electrodes 113, 115 and/or the distance between each of first and second end cap electrodes 113,115 and ring electrode 114 may be arranged so as to optimize the electric field generated within ion trap 119.

Ring electrode 114 may have any suitable shape, size and/or configuration in ion trap 119. Ring electrode 114 may also include any suitable conductive material (e.g., copper, silver, gold, platinum, iridium, platinum-iridium, platinum-gold, conductive polymers, stainless steel, etc.) or combinations of conductive (and/or noble metals) materials. In the exemplary embodiment, ring electrode 114 may be cylindrically shaped defining an opening therein. The opening may be aligned with first aperture 120 and second aperture 124. Although the depicted embodiment includes a single opening 128, it is contemplated that a greater or lesser number of openings may be provided in ring electrode 128.

Ion trap 119 may be configured to dynamically trap the ions in a quadrupole field within the spaced defined by first end cap electrode 113, second end cap electrode 115, and ring electrode 114. This field may be created through application of radio-frequency (RF) and direct current (DC) voltages to ring electrode 114 relative to first and second end cap electrodes 113, 115. The voltages applied to ring electrode 114 may be altered in order to selectively destabilize different masses of ions held within ion trap 119. The destabilized ions may be ejected from the ion trap 119 via second aperture 124.

As shown in FIG. 1, detector 117 is positioned outside chamber 110, and may be in communication with enclosed space 110*c* via an aperture 128 formed in second wall 110*b*. Aperture 128 may have any length, size, shape, and/or configuration to permit the ejected ions to reach detector 117. In some embodiments, a second lens 116 may be disposed in chamber 110 between second end cap electrode 115 and second wall 110*b*. Second lens 116 may be any suitable optical component configured to focus the ions emitted from ion trap 119 and directed at detector 117 to improve the resolution of system 100. Second lens 116 may include a mesh, screen, or grate to prevent high voltages from detector 117 from distorting the electric field within ion trap 119. In some embodiments, second lens 116 may not perform a lensing function. In those embodiments, second lens 116 may be configured to protect ion trap 119 from the voltages of detector 117.

Detector 117 is configured to detect the number of ions emitted from ion trap 119 at different time intervals that correspond to particular ion masses. Detector 117 may be of a type and kind well known in the art. Exemplary detectors include electron multipliers, photographic detectors, and stimulation-type detectors. In the exemplary embodiment, detector 117 may be a single-particle detector such as, for example, a discrete dynode electron multiplier or a channel electron multiplier.

Figure 2:
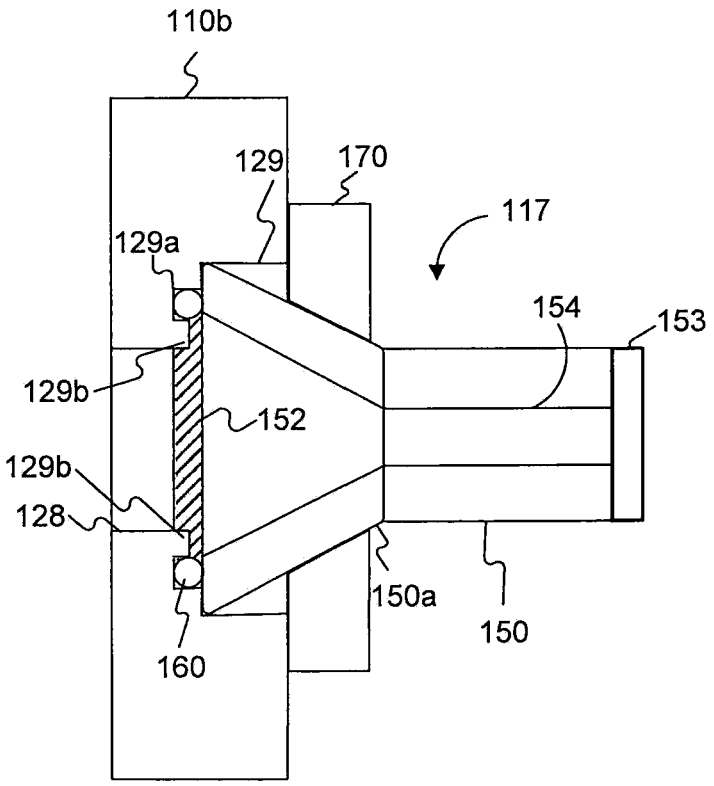
FIG. 2 is a partial cross-sectional view of the mass spectrometer system illustrating an exemplary detector coupled the chamber according to a first embodiment of the present disclosure.

In the exemplary embodiment shown in FIG. 2, detector 117 includes a tube 150 having an input end 152 and a sealed output end 153. Output end 153 may be sealed using, for example, an ultra-vacuum sealant to maintain low pressures within detector 117 and chamber 110*c*. The thickness of the sealant may be sufficient to prevent vacuum leaks from detector 117. Tube 150 may include a vacuum envelope, made from any suitable material known to one of ordinary skill in the art that is configured to maintain low pressures and has sufficient strength to withstand forces exerted by the external atmospheric pressure. Such materials may include, but are not limited to, metals, high density ceramics, glass, acrylic, Teflon, and plastics. It is contemplated that, in some embodiments, sealant may be disposed on other portions of tube 150 to cover apertures, windows, holes, etc. that would otherwise permit a vacuum leak.

Tube 150 may have any size, shape, and/or configuration, and may be any desired dimension for use in the miniaturized mass spectrometer system 100. In some embodiments, a portion of tube 150 adjacent input end 152 may be shaped to facilitate detection of one or more ions. In the exemplary embodiment, tube 150 includes a horn 150*a* having a conical shape that tapers from input end 152 towards output end 153. It is contemplated that, in some embodiments, tube 150 may include a cylindrical input end 152 having, for example, an enlarged diameter. The remainder of elongate member 120 may, for example, define a cylindrical shape having a substantially circular cross section. It is contemplated that, in some embodiments, the remainder of tube 150 may be curved.

In an exemplary embodiment shown in FIG. 2, detector 117 may be a channel electron multiplier having a tube 150 including a channel 154 extending between input end 152 and sealed output end 153. Channel 154 may, for example, have a cork-screw shape having any cross section. An inner surface of channel 153 may have a semiconductive coating, having secondary electron emitting properties.

The ejected ions may be received in channel 154 via input end 152. In channel 154, ions may contact the coating and, upon contact, may induce the emission of multiple electrons. In this manner, the ejected ions may produce, in a cascade multiplication process, current. The electrons may be configured to contact a plate or target at output end 153, which may then generate a signal.

Referring back to FIG. 1, detector 117 may be configured to output the generated signal to amplifier 118, which may amplify the signal generated by detector 117. Amplifier 118 may output the amplified signal to an analog-to-digital converter 130 which, in turn, may sample the amplified signal and output a digital version of the signal to processor 140 for analysis. As known in the art, processor 140 may then analyze the received signal to provide data to a user via a user interface (not shown) about the analyzed sample.

As alluded to above, detector 117 is positioned at an external location relative to chamber 110 so as to reduce the volume of chamber 110. In this way, by allowing the volume of the vacuum chamber to be smaller, mass spectrometers 100 consistent with the disclosed embodiments may use smaller and less expensive vacuum pumps (not shown in FIG. 1). In the present disclosure, detector 117 may be permanently or removably coupled to second wall 110*b* of chamber 110. Detector 117 and second wall 110*b* may be coupled in such a manner so as to maintain a vacuum environment in enclosed space 110*c* and channel 154.

FIG. 2 is a partial cross-sectional view of system 100 in accordance with a first embodiment of the disclosure. As shown in FIG. 2, chamber 110 includes a recess 129 configured to receive input end 152 of detector 117. Recess 129 may have any size, shape, and/or configuration, and may be aligned with aperture 128. Input end 152 of detector 117 may be configured to engage recess 129, so as to couple detector 117 to chamber 110. For example, input end 152 may be sized to securely fit in recess 129 by, for example, being press-fit into recess 129. It is contemplated that, in some embodiments, recess 129 and input end 152 may have complementary shapes so that input end 152 may be received in and retained by recess 129. In other embodiments, a portion of tube 150 may have threads, which may be screwed into or threadably engage a threaded portion of recess 129. When input end 152 is received in recess 129, input end 152 may be aligned with aperture 128 of second wall 110*b* to receive emitted ions from ion trap 119.

An o-ring 160 may be positioned between input end 152 of detector 117 and second wall 110*b* of chamber 110. O-ring 160 may be configured to facilitate sealing engagement between input end 152 and recess 129. O-ring 160 may be fabricated from an elastomeric, low friction material, and may be configured to provide a sealing interface between detector 117 and second wall 110*b*. O-ring 160 may have any size, shape, thickness, or cross-section. In alternative embodiments, a copper seal may be used in place of o-ring 160. In the exemplary embodiment of FIG. 2, o-ring 160 is disposed between input end 152 and second wall 110*b* in recess 129 in an annular groove 129*a* in recess 129. Annular groove 129*a* may include one or more protrusions 129*b* to retain o-ring 160 in groove 129*a*. While the depicted embodiment illustrates one o-ring 160, it will be understood that, in some embodiments, two or more o-ring may be used. Further, while FIG. 2 shows o-ring 160 being about the same thickness as annular groove 129*a* is deep, o-ring 160 may also be thicker than groove 129*a*. In such an implementation, input end 152 of detector 117 may first contact o-ring 160, causing o-ring 160 to deform and ensure a strong seal.

A fastener 170 may be provided to press input end 152 against o-ring 160. Fastener 170 may be any type or kind known to one of ordinary skill in the art including, bolts, screws, etc. As shown in FIG. 2, fastener 170 may be positioned about tube 150 and engage second wall 110*b* via one or more screws or clamps. In the screwed or clamped position, fastener 170 may be configured to exert pressure on tube 150 so as to press input end 152 into recess 129 and onto o-ring 160.

O-ring 160 may be configured to allow detector 117 to be externally mounted to vacuum chamber 110 without any loss of vacuum pressure in chamber 110. The sealing engagement of input end 152, o-ring 160, and second wall 110*b* in recess 129*a* may provide a pressure barrier so that enclosed space 110*c* of vacuum chamber 110 and channel 154 may be maintained at low pressures. It is contemplated that, in some alternative embodiments, o-ring 160 may be placed about horn 150*a*. In those embodiments, groove 129*a* is not provided. O-ring 160 may sealingly engage bolt 170, horn 150*a*, and recess 129 to maintain the low pressure in enclosed space 110*c* and channel 154.

Figure 3:
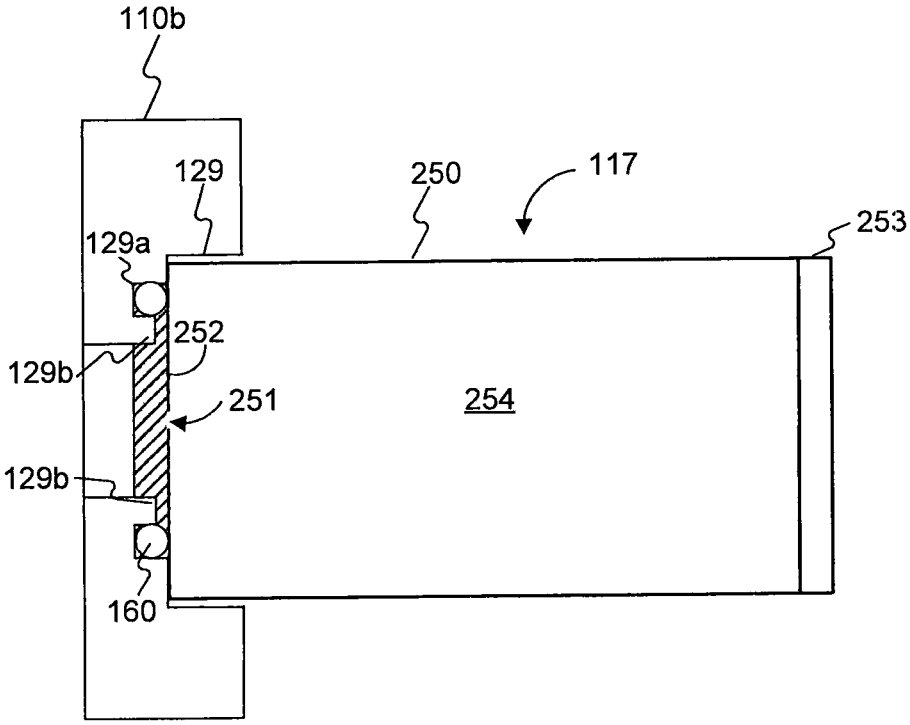
FIG. 3 is a partial cross-sectional view of another exemplary detector coupled to the chamber according to the first embodiment of the present disclosure.

FIG. 3 is a partial cross-sectional view of system 100 having another exemplary detector 117. In this embodiment, detector 117 may be a discrete dynode electron multiplier. As shown in FIG. 3, detector 117 may include a housing 250 constructed from any known material configured to provide a vacuum environment. Housing 250 may have any size, shape, and/or configuration, and may be any desired dimension for use in the miniaturized mass spectrometer system 100. In the exemplary embodiment, housing 250 has a cylindrical shape and defines an input end 252 and a sealed output end 253. As shown in FIG. 3, input end 252 defines an aperture 251 for receiving the ions ejected from ion trap 119. Output end 253 is sealed using, for example, an ultra-vacuum sealant to maintain low pressures within chamber 110*c* and an interior of housing 250. In use, ejected ions may enter detector 117 via aperture 251 on input end 252 and may contact one or more discrete electrodes encased in a space 254 within housing 250 to produce, in a cascade multiplication process, current. The electrons may be configured to contact a plate or target at output end 253, which may then generate a signal to be output from detector 117.

As in the embodiment described above, input end 252 may be coupled to second wall 110*b* of chamber 110 so as to maintain a vacuum environment in enclosed space 110*c* and space 254 of housing 250. More particularly, input end 252 of detector 117 may be configured to engage recess 129, so as to couple detector 117 to chamber 110. In some embodiments, input end 252 may be sized to securely fit in recess 129 by, for example, being press-fit into recess 129. In other embodiments, input end 252 may be threadably coupled to recess 129. When input end 252 is received in recess 129, aperture 251 on input end 252 may be aligned with aperture 128 of second wall 110*b* to receive emitted ions from ion trap 119.

As in the embodiment described above, an o-ring 160 may be positioned between input end 252 of detector 117 and second wall 110*b* of chamber 110. As in the embodiment described above, o-ring 160 is disposed between input end 152 and second wall 110*b* in recess 129 in an annular groove 129*a* in recess 129. Annular groove may include one or more protrusions 129*b* to retain o-ring 160 in groove 129*a*.

O-ring 160 may be configured to allow detector 117 to be externally mounted to vacuum chamber 110 without any loss of vacuum pressure in chamber 110. It is contemplated that, in some additional embodiments, a fastener may be positioned about housing 250 to fasten housing 250 to second wall 110*b* of chamber 110. In those embodiments, the fastener may be configured to exert pressure on tube 250 so as to press input end 252 into recess 129 and onto o-ring 160. This, in turn, may provide a pressure barrier so that enclosed space 110*c* of vacuum chamber 110 and the interior of housing 250 may be maintained at low pressures.

Figure 4:
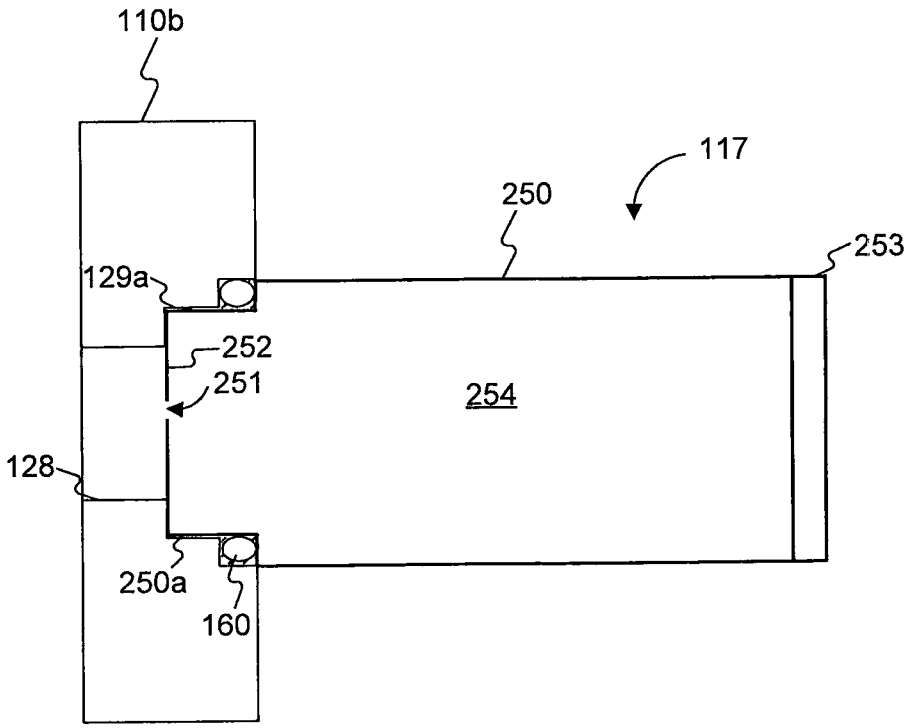
FIG. 4 is a partial cross-sectional view of the exemplary detector of FIG. 3 coupled to the chamber according to a second embodiment of the present disclosure.

FIG. 4 is a partial cross-sectional view of system 100 in accordance with a second embodiment of the disclosure. As in the embodiment described above, detector 117 has a housing 250, an input end 252, and a sealed output end 253. In this embodiment, however, a portion 250*a* of housing 250 may have a reduced diameter compared to other portions of housing 250. Reduced diameter portion 250*a* may be received in recess 129 by, for example, threadably engaging complementary threads forms in recess 129. In this embodiment, o-ring 160 may be placed about reduced diameter portion 250*a* to provide a pressure barrier so that enclosed space 110*c* of vacuum chamber 110 and interior 254 of housing 250 may be maintained at low pressures. It is contemplated that, in some embodiments, second wall 110*b* and/or housing 250 may have complementary screws and/or threads to facilitate engagement of detector 117 and chamber 110.

Figure 5:
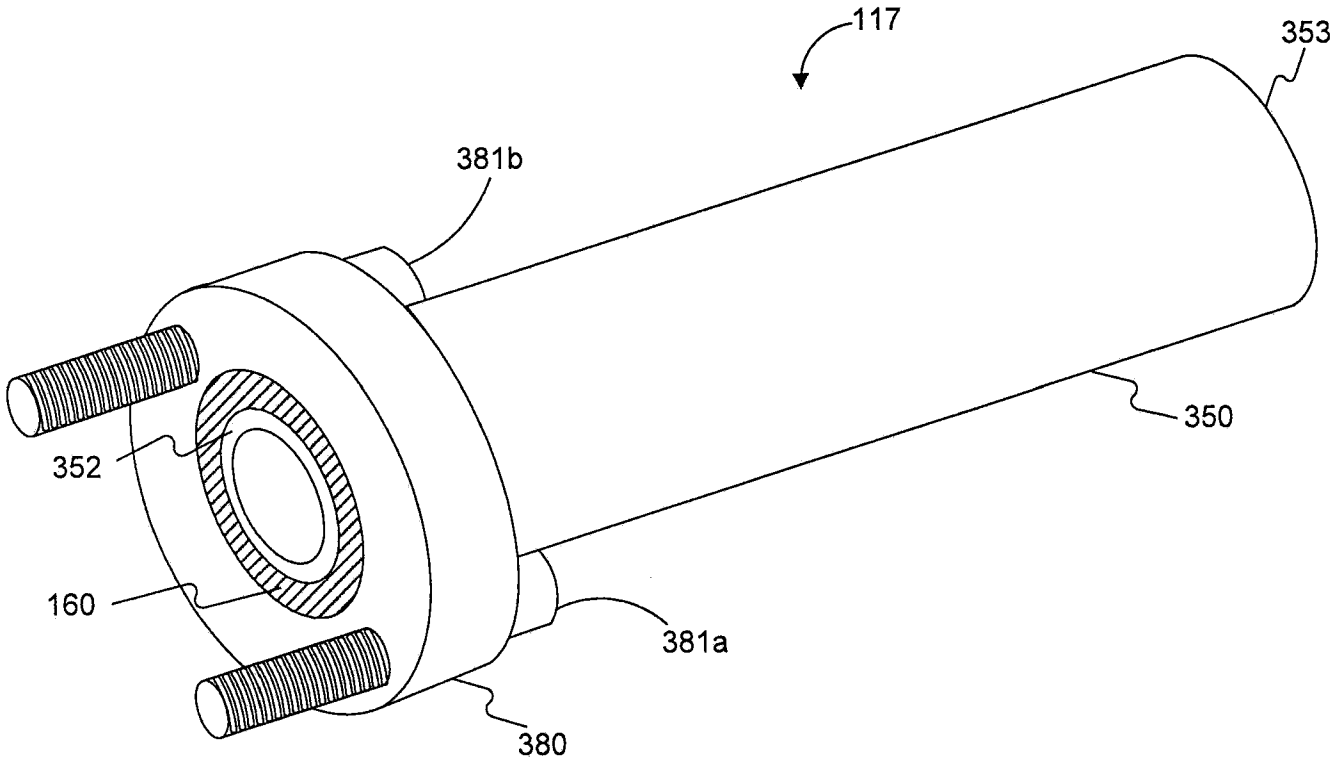
FIG. 5 is a perspective view of an exemplary detector to be coupled to the chamber according to a third embodiment of the present disclosure.

FIG. 5 illustrates detector 117, in accordance with a fourth embodiment of the disclosure. In this embodiment, detector 117 may either a channel electron multiplier or a discrete dynode electron multiplier. Detector 117 may include a housing 350 having an input end 352 and a sealed output end 353. As shown in FIG. 5, a fastening assembly 380 may be coupled to input end 352. Fastening assembly 380 may removably or permanently engage housing 350, and may be positioned at input end 352. Fastening assembly 380 may be configured to position detector 117 relative to second wall 110*b*, and fasten detector 117 to second wall 110*b* to provide a pressure barrier to maintain low pressure within space 110*c*. As shown in FIG. 5, input end 352 may have a seal, o-ring, or gasket 160 that forms a sealing interface between fastening assembly 380, second wall 110*b* of chamber 110, and input end 352 in such a manner to avoid any loss of vacuum pressure.

Fastening assembly 380 may include a bolt having one or more apertures to receive one or more screws. In the exemplary embodiment, bolt 382 includes two apertures to receive two screws 381*a* and 381*b*. Each screw 381*a*, 381*b* may include threads that may be designed to mate with a complementary thread. In the exemplary embodiment, screws 381*a* and 381*b* may engage second wall 110*b* to couple detector 117 to an outer surface of second wall 110*b*. More particularly, during assembly, input end 352 may be positioned adjacent to, or flush with, an outer surface of second wall 110*b* so that a channel (not shown) may be in communication with aperture 128 of second wall 110*b*. Screws 381*a* and 381*b* may then be configured to engage second wall 110*b* to provide a sealing interface so as to maintain the low pressure in enclosed space 110*c* and housing 350.

Embodiments described herein may have several benefits. By mounting detector 117 externally, chamber 110 may no longer need one or more electrical connectors or ports, which are typically used to provide power to detector 117. This may reduce the cost and complexity of mass spectrometer system 100. Additionally, the disclosed configuration may protect the detector output signal from interference caused by the RF signal applied to ion trap 119. The disclosed configuration also minimizes the surface area inside chamber 110, by allowing only the interior surface of detector 117 to be exposed to the chamber interior 110*c*.

Additionally the disclosed embodiments may operate to reduce the size of chamber 110 so that mass spectrometer system 100 may be used in places where conventional units could not be used because of cost and the size of the conventional units. For example, mass spectrometer 100 may be placed in a hazard site to analyze gases and remotely send back a report of conditions presenting danger to personnel. Mass spectrometer 100 using embodiments herein may be placed at strategic positions on air transport to test the environment for hazardous gases that may be an indication of malfunction or even a terrorist threat. The present disclosure has anticipated the value in reducing the size required to make a functioning mass spectrometer so that its operation may be used in places and in applications not normally considered for such a device.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A mass spectrometer system, comprising:
   a vacuum chamber defining an enclosed evacuated space;
   an ion trap disposed in the enclosed space, the ion trap being configured to trap an ionized sample; and
   an ion detector coupled to the chamber at a location external to the chamber, such that sample ions may exit the evacuated space and into the externally-coupled detector without loss of vacuum pressure.

2. The mass spectrometer system of claim 1, wherein the chamber includes an aperture configured to direct ions ejected from the ion trap to the detector.

3. The mass spectrometer system of claim 1, further including a pump to maintain the chamber under vacuum, wherein the externally-coupled detector is housed in a portion of the mass spectrometer that is not under vacuum.

4. The mass spectrometer system of claim 1, wherein the ion detector includes an internal detector tube under vacuum.

5. The mass spectrometer system of claim 4, wherein the tube includes an input end and an output end, wherein the input end is configured to engage a wall of the chamber to provide a pressure barrier so as to maintain the chamber and an interior of the tube under vacuum.

6. The mass spectrometer system of claim 5, wherein the output end is sealed from the ambient air.

7. The mass spectrometer system of claim 1, wherein the chamber has a volume to accommodate only an electron source and the ion trap.

8. A mass spectrometer system, comprising:
   a chamber configured to be maintained under vacuum, the chamber including:
      an ion trap configured to capture ions generated when a sample is ionized by electrons emitted from an electron source; and an ion detector configured to detect ions ejected from the ion trap, the ion detector including a tube configured to be maintained under vacuum, the tube being coupled to a wall of the chamber at a location external to the chamber.

9. The mass spectrometer system of claim 8, wherein the wall of the chamber defines a recess.

10. The mass spectrometer system of claim 9, wherein the tube includes an input end, and wherein the input end is configured to be received in the recess to couple the ion detector to the chamber.

11. The mass spectrometer system of claim 10, further including an o-ring disposed between the input end and the wall in the recess, wherein the o-ring is configured to provide a sealing interface between the input end and the recess.

12. The mass spectrometer system of claim 11, wherein the recess includes a groove to receive the o-ring.

13. The mass spectrometer system of claim 10, further including a fastener to exert pressure onto the tube to press the input end into the recess.

14. The mass spectrometer system of claim 10, wherein the input end is sized to be press-fit into the recess.

15. The mass spectrometer system of claim 8, wherein the tube includes a fastening assembly configured to position the detector relative to the wall so that an input end of the tube is flush against an outer surface of the wall.

16. A mass spectrometer system, comprising:

a chamber defining an enclosed space configured to be maintained under vacuum, the chamber including:

an electron source configured to emit ions;

an ion trap including:

a ring electrode; and first and second end cap electrodes which are arranged on opposite sides of the ring electrode, wherein the first end cap electrode includes a first aperture through which electrons emitted by an electron source enter the ion trap, and the second end cap electrode includes a second aperture through which ions are discharged from the ion trap; and an ion detector configured to detect an amount of ions ejected from the ion trap, the ion detector being coupled to the chamber at a location external to the chamber.

17. The mass spectrometer system of claim 16, further including an amplifier coupled to the ion detector at a location external to the chamber.

18. The mass spectrometer system of claim 16, wherein the ion detector is a discrete dynode electron multiplier.

19. The mass spectrometer system of claim 16, wherein the ion detector is a channel electron multiplier (CEM).

20. The mass spectrometer system of claim 16, wherein the ion detector includes a vacuum tube having an input end and an output end, wherein the input end sealingly engages a wall of the chamber.

* * * * *